US005156805A

United States Patent [19]

Imai et al.

[11] Patent Number: 5,156,805

[45] Date of Patent: Oct. 20, 1992

[54] PROCESS OF PREPARING A FERRITIC ALLOY WITH A WEAR-RESISTIVE ALUMINA SCALE

[75] Inventors: Junji Imai, Amagasaki; Shuji Yamada, Ashiya; Tadashi Hamada, Sakai; Hajime Kojima, Hirakata; Masao Tanahashi, Hikone, all of Japan

[73] Assignee: Matsushita Electric Works, Ltd., Osaka, Japan

[21] Appl. No.: 735,901

[22] Filed: Jul. 25, 1991

[30] Foreign Application Priority Data

Jul. 31, 1990 [JP] Japan ..... 2-203578

[51] Int. Cl.[5] ..... G22F 1/00

[52] U.S. Cl. ..... 419/19; 419/38; 419/45; 419/54; 419/57; 419/60; 428/552; 428/632; 428/472.2

[58] Field of Search ..... 419/45, 57, 19, 60, 419/54, 38; 428/552, 632, 472.2

[56] References Cited

U.S. PATENT DOCUMENTS

| | | | |
|---|---|---|---|
| 4,144,380 | 3/1979 | Beltran et al. | 428/679 |
| 4,661,169 | 4/1987 | Aggen et al. | 198/2 |
| 4,751,099 | 6/1988 | Niino et al. | 427/34 |
| 5,089,223 | 2/1992 | Hamada et al. | 420/40 |

FOREIGN PATENT DOCUMENTS 2105752 3/1983 United Kingdom .

*Primary Examiner*—Steven J. Lechert, Jr.
*Attorney, Agent, or Firm*—Stevens, Davis, Miller & Mosher

[57] ABSTRACT

A ferritic alloy with a wear resistive oxide scale is obtained through the steps of pressing a ferritic alloy powder containing aluminum into a powder compact of a desired configuration, sintering the powder compact in a non-oxidizing atmosphere to provide a resulting sintered product, and heat-treating the sintered product in an oxidizing gas atmosphere in order to precipitate in the surface thereof alumina in the form of an alumina scale as the wear resistive oxide scale which is responsible for improved surface hardness or wear resistance. Due to the inherent porous nature of the sintered product, the oxidizing gas can readily penetrate deep into the surface of sintered product to facilitate the oxidization of the product surface into the alumina scale, in addition to that the oxidization depth can be controlled such as by the density of the product, which makes it possible to readily control the thickness of the alumina scale. The resulting alumina scale has an improved scale adherence due to the ferritic structure of the alloy.

6 Claims, 1 Drawing Sheet

PROCESS OF PREPARING A FERRITIC ALLOY WITH A WEAR-RESISTIVE ALUMINA SCALE

BACKGROUND OF THE INVENTION

1. Field of the Invention

The present invention is directed to a process of preparing a ferritic alloy formed in its surface with an oxide scale of alumina having improved wear resistance as well as mechanical strength.

2. Description of the Prior Art

Ceramics or alloys have been utilized in the art as forming the cutting tools and the mechanical elements such as gears and shafts requiring increased wear resistance. The ceramics is known to give an increased wear resistance or surface hardness as high as 2000 Hv, but suffers from the inherent disadvantage of insufficient toughness resulting in crack or fracture. On the other hand, the alloys are known to have sufficient toughness but to give only poor surface hardness as less as 1100 Hv. Consequently, it has been proposed to provide on the alloy surface an extra layer of superior wear resistance, for example, TiN or ZrN layer by spattering or chemical vapor deposition (CVD) techniques. Such extra layer is, however, found to have rather less adherence to the base alloy, in addition to that it is difficult to be formed into sufficient thickness, which result practically in poor performance.

To overcome the above disadvantages, the recent technology has proposed hot oxidation resistive alloys which forms in its surface an aluminum oxide scale under hot oxidation atmospheres. For example, the preceding U.S. application Ser. No. 604,231, now U.S. Pat. No. 5,089,223, discloses ferritic alloys capable of forming in its surface an aluminum oxide scale, i.e., alumina scale with improved wear resistance, toughness, and superior scale adherence to the matrix. The ferritic alloy is prepared by casting an alloy liquid composition in a mold to obtain an ingot which is subsequently machined into a desired shape. Then, the resulting product is heated in an oxidizing atmosphere to form in the surface thereof the alumina scale. With this process, it is difficult not only to give a complicate shape to the product but also to obtain an increased thickness of the alumina scale due to the fact that the oxidization is substantially limited to the skin-deep area in the surface of the alloy product. In other words, because of the dense surface structure of the cast product, the oxidizing gas is only supplied to the surface of the product such that the oxidization into the alumina scale will be soon saturated in the skin-deep area to thereby inhibit further formation of the alumina scale in the deep area. Further, since the thickness of the alumina scale is substantially dependent only upon the hot corrosion or oxidization condition, there is less flexibility in control the thickness of the aluminum oxide scale.

SUMMARY OF THE INVENTION

The above disadvantages and insufficiencies have been eliminated in the present invention which provides an improved process of preparing a ferritic alloy with a wear-resistive alumina scale. The improved process in accordance with the present invention comprises the steps of pressing a ferritic alloy powder containing aluminum into a powder compact of a desired configuration, sintering the powder compact in a non-oxidizing atmosphere to provide a resulting sintered product, and heat-treating the sintered product in an oxidizing gas atmosphere in order to precipitate alumina in the surface in the form of an alumina scale as the wear resistive oxide scale. Since the sintered product has a porous structure, the oxidizing gas is permitted to penetrate deep into the product to thereby facilitate the oxidization of the product surface into the alumina scale with an increased depth or thickness. In this connection, the oxidization depth can be controlled by, in addition to the oxidizing parameters of temperature and time, the density of the sintered product which is easily obtained at the step of forming the powder compact. Further, the resulting aluminum oxide scale has an improved scale adherence resulting from the ferritic structure of the alloy.

Accordingly, it is a primary object of the present invention to provide an improved process of preparing a ferritic alloy having a wear-resistive alumina scale which is capable of forming the alumina scale in an increased thickness and easily controlling the thickness, yet assuring improved wear resistance and scale adherence.

Although an Fe-Cr-Al alloy may be utilized where relatively less surface hardness of about 200 Hv is required, an Fe-Cr-Ni-Al alloy is preferred in order to obtain superior surface hardness as high as 300 Hv or more, which alloy consists essentially of by weight 20 to 35% of chromium, 2 to 25% of nickel, 2 to 8% of aluminum, 0.5% or less of titanium, 0.05 to 1.0% of at lease one element selected from the group consisting of zirconium, yttrium, hafnium, cerium, lanthanum, neodymium, gadolinium, and balance iron. The corresponding alloy powder, which be obtained either by atomization or by milling, is blended with an organic binder and is pressed by injection molding or isostatic pressing technique into a powder compact having a desired configuration as near as a final shape, requiring a minimum amount of secondary finishing. The organic binder includes, for example, polyvinyl alcohol and ethylene glycol. The compacting pressure is preferably about 400 MPa [Mega Pascal] to give a precision powder compact.

The powder compact is heated in an non-oxidizing atmosphere to a temperature range of 1250° to 1400° C., preferably of 1300° to 1400° C., within which the powder compact can be sintered without causing any substantial liquid phase in the sintering to give hardness of as high as 300 Hv and tensile strength of as high as 100 kg/mm or more, strong enough to form machine elements. The non-oxidizing atmosphere is essential in the sintering because of that the effective sintering would not be otherwise obtained and that the oxidized sintered product would suffer from reduced toughness. The non-oxidizing atmosphere can be realized by an inert gas such as argon and helium, by a reducing gas such as hydrogen, or by vacuum. Due to the ferritic structure, thus obtained sintered product can be readily machined or electro-discharge formed into a precise final shape prior to precipating the alumina in the surface thereof by exposure to hot oxidization environment. Then, the sintered product is heated to a temperature of above 1000° C. in the oxidizing atmosphere or hot oxidization environment so that sintered product forms the protective dense scale of an alumina $Al_2O_3$ which exhibits strong adherence to a remaining substrate or matrix as well as remarkably improved wear resistance. Further, the alumina scale can be formed into a thickness of as thick as 10 to 50 μm at this hot oxidization due to the inherent porous nature of the sintered product. The resulting alloy product therefore exhibits improved wear resistance at the alumina scale which is strongly anchored in the matrix and retains an improved toughness at the matrix resulting from the ferritic structure of the alloy.

Because of the excellent wear resistance and improved mechanical properties, the alloy obtained by the present invention can be best utilized as the material forming the following listed articles.

1) Home use cutting tools including blades for dry shavers; blades for clippers particularly for a garden use or pet use where pebbles or the like foreign matters are likely present in the grass or pet's hairs; blades for lawn mowers, blades for food processors or blenders, kitchen knives, scissors, and saws;

2) Industrial use cutting tools including blades for power saws, lathe tools, dies, and screws for kneaders; and 3) Wear resistive mechanical elements including power drill bits and chucks, gears, rotary shafts, and bearings.

Figure 1:
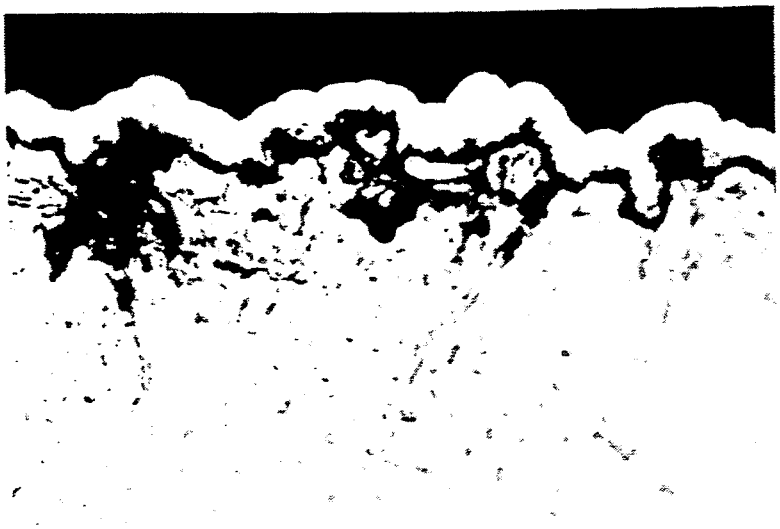
FIG. 1 is a photomicrograph at a 700× magnification of the surface structure of a sintered alloy product obtained in Example 4 of the present invention, with a Ni plating is added on an alumina scale of the alloy for easy observation of the alumina scale.

The following examples show comparative results, but it is to be understood that these examples are given by way of illustration and not of limitation. All percentages are on a weight basis.

EXAMPLE 1

An alloy consisting of 24% Cr, 4% Ni, 3.5% Al, 0.05% Zr, and balance Fe was melted in a high frequency induction furnace to provide an ingot which was subsequently hot rolled into a 1 to 2 mm thick plate. The plate was then chopped into 2 to 3 mm square chips followed by being milled into a corresponding ferritic alloy powder having a particle size of 350 μm or less. The resulting alloy powder was blended with polyvinyl alcohol [PVA] and was filled into a rack-forming cavity and isostatically pressed to form a rack-shaped powder compact. The powder compact was then sintered in a vacuum of $10^{-4}$ Torr at a temperature of 1250° C. for 5 hours to obtain a sintered product. Thereafter, the sintered product was heat-treated at a temperature of 1150° C. in an atmospheric environment for 10 hours in order to precipitate alumina [$Al_2O_3$] in the surface of the sintered product, presenting a rack product of Fe-Cr-Ni-Al ferritic alloy with a gray oxide scale of alumina.

EXAMPLE 2

An alloy consisting of 30% Cr, 21% Ni, 6% Al, 0.5% Ti, 0.2% Zr, and balance Fe was melted in a high frequency induction furnace followed by being atomized into a corresponding ferritic alloy powder having a particle size of 50 μm or less. The resulting alloy powder was processed in the same manner and conditions as in Example 1 to provide a resulting sintered rack product of Fe-Cr-Ni-Al ferritic alloy with an oxide scale of alumina.

EXAMPLE 3

An alloy consisting of 26% Cr, 21% Ni, 6.5% Al, 0.2% Zr, and balance Fe was melted in a high frequency induction furnace followed by being atomized into a corresponding ferritic alloy powder having a particle size of 50 μm or less. The resulting alloy powder was process in the same manner as in Example 1 to provide a rack-shaped powder compact. The powder compact was sintered in an hydrogen gas atmosphere at a temperature of 1350° C. for 5 hours to obtain a sintered product, which was subsequently heat-treated at a temperature of 1150° C. in an atmospheric environment for 10 hours to precipitate alumina in the surface thereof, presenting a rack product of Fe-Cr-Ni-Al ferritic alloy with a gray oxide scale of alumina. The resulting rack products of Examples 1 to 3 were evaluated with regard to surface hardness, matrix hardness (hardness of the inner portion of the alloy), alumina content (wt%) in the oxidized layer or scale and alumina scale thickness which are listed in Table 1. Also the alumina scales of Examples 1 to 3 were observed by an electron microscope from which it is confirmed that alumina forms a needle-like configuration growing into the matrix so as to be firmly anchored thereto for increased scale adhesion. In this connection, the alumina scale thickness was measured as a maximum value at a portion extending deep into the alloy product. Table 1 also includes, for comparison purpose, the corresponding data for a cemented carbide material [classified as SKH-5 according to Japanese Industrial Standard] as well as an alumina ceramic. From Table 1, it is readily confirmed that Examples 1 to 3 can form the alumina scale exhibiting an increased surface hardness as high as the alumina ceramic.

TABLE 1

| | Composition [wt %] | | | | | | surface hardness | matrix hardness | alumina content in oxide scale | alumina scale thickness [μm] |
|---|---|---|---|---|---|---|---|---|---|---|
| | Cr | Ni | Al | Zr | Ti | Fe | [Hv] | [Hv] | | |
| Example 1 | 24.0 | 4.0 | 3.5 | 0.05 | — | balance | 2000 | 450 | 95 wt % | 10–15 |
| Example 2 | 30.0 | 21.0 | 6.0 | 0.2 | 0.5 | balance | 2000 | 550 | 95 wt % | 15–25 |
| Example 3 | 26.0 | 21.0 | 6.5 | 0.2 | — | balance | 2000 | 500 | 95 wt % | 20–30 |
| Reference 1 #1) | C: 0.3 Cr: 4.0 W: 20.0 V: 1.3 Co: 16 Fe: balance | | | | | | 700 | 700 | — | — |
| Reference 2 #2) | $Al_2O_3$ | | | | | | 2000 | 2000 | 99 wt % | — |

#1): cemented carbide SKH5 [JIS]
#2): ceramics

EXAMPLE 4

Figure 2:
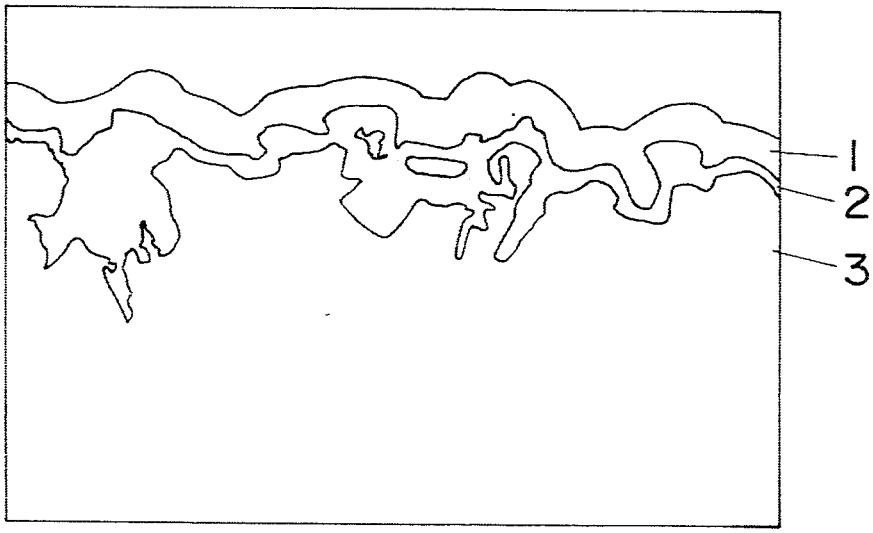
FIG. 2 is a sketch schematically illustrating the surface structure of the alloy product of Example 4 in correspondence to the photomicrograph of FIG. 1.
Figure 3:
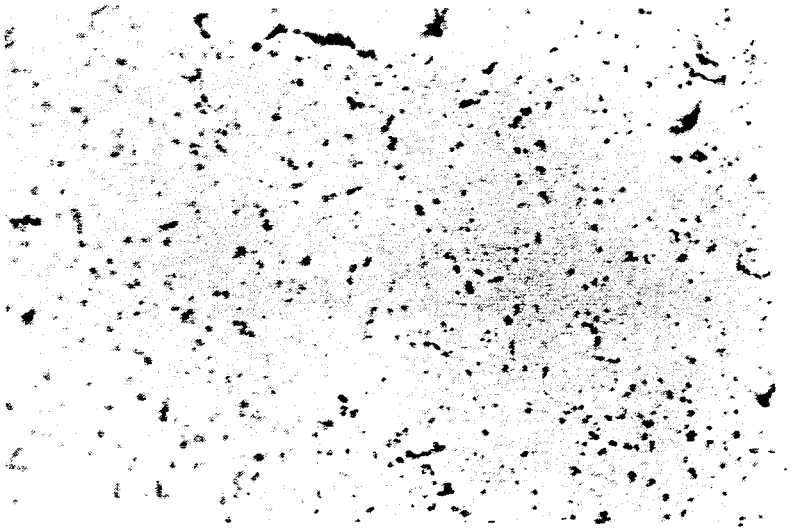
FIG. 3 is a photomicrograph at a 700× magnification of an internal structure of the sintered alloy product of Example 4.

An alloy consisting of 32% Cr, 21% Ni, 6.5% Al, 0.8% Zr, and balance Fe was melted in a high frequency induction furnace followed by being atomized into a corresponding ferritic alloy powder having a particle size of 50 μm or less. The resulting alloy powder was blended with a PVA binder and was pressed under 450 MPa [Mega Pascal] into a billet powder compact having a diameter of 10 mm and a length of 10 mm. The powder compact was then sintered in a vacuum at a temperature of 1350° C. for 3 hours to obtain a corresponding sintered product. After being ground into a final desired shape, the sintered product was heat-treated in an atmospheric environment at a temperature of 1150° C. for 20 hours followed by being heated at a raised temperature of 1250° C. for 30 minutes in order to precipitate alumina in the surface of the sintered product. The resulting product was cooled in the air at a rate of about 100° C. per sec. to present an Fe-Cr-Ni-Al ferritic alloy product with an oxide scale of alumina. FIGS. 1 and 2 show a surface of the alloy product respectively in a photomicrograph at a 700× magnification and in a corresponding sketch thereof wherein a Ni plating 1 is added on the alumina scale 2 anchored to an alloy matrix 3 for providing a clear recognition of the surface configuration of the alumina scale. FIG. 3 shows an internal structure of the alloy matrix 3 in a photomicrograph at a 700× magnification. In the photomicrographs of FIGS. 1 and 3, the matrix 3 is shown to include minute voids as black dots and intermetallic Ni-Al compounds as gray dots in the white background of ferritic phase. As seen in the figures, the minute intermetallic Ni-Al compounds are dispersed evenly in the matrix due to the ferritic structure of the alloy for increasing mechanical strength including hardness and toughness.

EXAMPLE 5

A like ferric alloy product was obtained through the identical processes as Example 4 except that the powder compact was compressed at a pressure of 600 MPa.

EXAMPLE 6

An Fe-Cr-Ni-Al ferritic alloy powder obtained in Example 1 was blended with a PVA binder and pressed at a pressure of 1000 MPa into a billet powder compact of the same configuration (10 mm $\phi \times 10$ mm) as that of Example 4. The resulting billet was sintered in an argon gas atmosphere at a temperature of 1300° C. for 5 hours to obtain a sintered product. After being ground into a final desired shape, the sintered product was heat-treated in the identical condition as in Example 4 to present an Fe-Cr-Ni-Al ferritic alloy product with an oxide scale of alumina.

EXAMPLE 7

An alloy consisting of 35% Cr, 21% Ni, 7% Al, 0.4% Zr, and balance Fe was melted in a high frequency induction furnace followed by being atomized into a corresponding ferritic alloy powder having a particle size of 50 μm or less. The resulting alloy powder was blended with a PVA binder and was pressed under 700 MPa into a billet powder compact of the same configuration (10 mm $\phi \times 10$ mm) as that of Example 4. The powder compact was then sintered in a vacuum at a temperature of 1350° C. for 4 hours to obtain a corresponding sintered product. After being ground into a final desired shape, the sintered product was heat-treated in the identical condition as in Example 4 to present an Fe-Cr-Ni-Al ferritic alloy product with an oxide scale of alumina.

EXAMPLE 8

An Fe-Cr-Ni-Al ferritic alloy product with an oxide scale of alumina was obtained in the identical manner and condition as Example 7 except that the powder compact was pressed at a pressure of 900 MPa and sintered at a temperature of 1300° C.

EXAMPLE 9

The alloy powder of Example 4 was sieved to obtain a fine powder having a particle size of 30 μm or under. Thus sieved alloy powder was blended with an organic binder composed mainly of 10% of paraffin wax and stearic acid and was injection-molded at a temperature of 150° C. into a powder compact of a desired shape. The resulting powder compact was then heated in a vacuum at a temperature of 40° C. for 50 hours to debind an excess amount of the binder. Thus debinded powder compact was then sintered in a vacuum within a furnace at a temperature of 1350° C. for 3 hours followed by being heated at a temperature of 1250° C. in the presence of an oxygen gas supplied into the furnace for 30 minutes so as to precipitate alumina in the surface of the sintered product, thereby presenting an Fe-Cr-Ni-Al ferritic alloy product with an oxide scale of alumina.

EXAMPLE 10

An injection-molded powder compact obtained in the identical manner as in Example 9 was debinded in an argon gas atmosphere at a temperature of 500° C. for 50 hours. The debinded compact was sintered in an argon gas atmosphere within a furnace at a temperature of 1350° C. for 3 hours followed by being heated at a temperature of 1250° C. for 30 minutes in the presence of an oxygen gas supplied into the furnace, thereby precipitating alumina in the surface of the alloy and presenting an Fe-Cr-Ni-Al ferritic alloy product with an oxide scale of alumina.

EXAMPLE 11

The alloy powder obtained in Example 7 was sieved into a fine powder having a particle size of 30 μm or under. The fine powder was compressed and sintered in the identical manner and conditions as in Example 9 to present an Fe-Cr-Ni-Al sintered product with the aluminum oxide scale.

EXAMPLE 12

An Fe-Cr-Ni-Al ferritic alloy product was obtained in the identical manner and conditions as Example 4 except that the sintering was made at a lowered temperature of 1200° C.

EXAMPLE 13

An Fe-Cr-Ni-Al ferritic alloy product was obtained in the identical manner and conditions as Example 6 except that the powder compact was pressed at a reduced pressure of 350 MPa.

The alloy products of Examples 4 to 13 were evaluated with respect to alumina scale property, matrix hardness, dimension accuracy, and scale thickness, the results of which are listed in Table 2. The alumina scale property is judged to be fine when the alumina scale is kept secured over the entire surface of the alloy without being flaked off even after heat impact experienced at the air cooling thereof and at the same time the alumina scale retains a minimum thickness of 2 to 3 μm. The dimension accuracy is judged to be fine when the final alloy product has a 5% tolerance or less relative to the ground sintered product. The alumina scale thickness was measured as a maximum value at a portion extending deep into the alloy product. Although not listed in Table 2, the alloy products of Examples 4 to 13 exhibit a superior surface hardness of 2000 Hv or more. As known from table 2, the matrix hardness of Example 12 is reduced to 400 Hv, which may be insufficient when formed into a cutting tool or the like part requiring a relatively high mechanical strength. Also, Example 13 exhibits poor scale property with a number of small flaking, reduced matrix hardness, and unacceptable dimensional accuracy of above 5% tolerance. Therefore, it is mostly preferred to press the alloy powder into the powder compact at a sufficiently high pressure and also to effect the sintering at an elevated temperature of 1300° to 1400° C. for the ferritic alloy in order to obtain the superior characteristics required in the alloy product which is utilized as forming a cutting tool, a mechanical element or the like.

TABLE 2

| | compacting pressure [MPa] | sintering temperature & time | oxidation temperature & time | alumina scale property | matrix hardness [Hv] | maximum alumina scale thickness μm | dimensional accuracy |
|---|---|---|---|---|---|---|---|
| Example 4 | 450 | 1350° C. 3 hrs | 1150° C. 20 hrs + 1250° C. 30 min. | fine | 450 | 20–30 | fine |
| Example 5 | 600 | 1350° C. 3 hrs | 1150° C. 20 hrs + 1250° C. 30 min. | fine | 450 | 20–30 | fine |
| Example 6 | 1000 | 1300° C. 5 hrs | 1150° C. 20 hrs + 1250° C. 30 min. | fine | 450 | 10–15 | fine |
| Example 7 | 700 | 1350° C. 4 hrs | 1150° C. 20 hrs + 1250° C. 30 min. | fine | 550 | 40–50 | fine |
| Example 8 | 900 | 1300° C. 4 hrs | 1150° C. 20 hrs + 1250° C. 30 min. | fine | 550 | 40–50 | fine |
| Example 9 | 900 | 1350° C. 3 hrs | 1250° C. 30 min. | fine | 500 | 20–30 | fine |
| Example 10 | 900 | 1350° C. 3 hrs | 1250° C. 30 min. | fine | 450 | 20–30 | fine |
| Example 11 | 900 | 1350° C. 3 hrs | 1250° C. 30 min. | fine | 550 | 40–50 | fine |
| Example 12 | 450 | 1200° C. 3 hrs | 1150° C. 20 hrs + 1250° C. 30 min. | fine | 400 | 20–30 | fine |
| Example 13 | 350 | 1300° C. 5 hrs | 1150° C. 20 hrs + 1250° C. 30 min. | poor | 400 | not available | poor |

What is claimed is:

1. A process of preparing a ferritic alloy having in its surface a wear resistive oxide scale, said process comprising the steps of:

pressing a ferritic alloy powder containing aluminum into a powder compact of a desired configuration;

sintering said powder compact in a non-oxidizing atmosphere to provide a resulting sintered product;

heat-treating said sintered product in an oxidizing gas atmosphere in order to precipitate alumina in the surface of said sintered product in the form of an alumina scale as said wear resistive oxide scale.

2. A process as set forth in claim 1, wherein said alloy powder consisting essentially of by weight 20 to 35% of chromium, 2 to 25% of nickel, 2 to 8% of aluminum, 0.5% or less of titanium, 0.05 to 1.0% of at least one element selected from the group consisting of zirconium, yttrium, hafnium, cerium, lanthanum, neodymium, gadolinium; and balance iron.

3. A process as set forth in claim 1, wherein said powder compact is sintered at a temperature of 1300° to 1400° C. in said non-oxidizing atmosphere.

4. A process as set forth in claim 1, wherein said non-oxidizing atmosphere is an inert gas atmosphere.

5. A process as set forth in claim 1, wherein said non-oxidizing atmosphere is a reducing gas atmosphere.

6. A process as set forth in claim 1, wherein said non-oxidizing atmosphere is a vacuum atmosphere.

* * * * *